US006622800B2

(12) United States Patent
van der Walt

(10) Patent No.: US 6,622,800 B2
(45) Date of Patent: Sep. 23, 2003

(54) FIREBREAK-FORMING EQUIPMENT

(76) Inventor: Leon Norman van der Walt, P.O. Box 912-784, Silverton (ZA), 0127

( * ) Notice: Subject to any disclaimer, the term of this patent is extended or adjusted under 35 U.S.C. 154(b) by 0 days.

(21) Appl. No.: 10/058,249

(22) Filed: Jan. 25, 2002

(65) Prior Publication Data

US 2002/0084079 A1 Jul. 4, 2002

Related U.S. Application Data

(63) Continuation of application No. PCT/ZA00/00126, filed on Jul. 26, 2000.

(30) Foreign Application Priority Data

Sep. 6, 1999 (ZA) ..... 99/5721
Jul. 27, 1999 (ZA) ..... 99/4795

(51) Int. Cl.[7] ..... A62C 25/00; A62C 27/00; A62C 29/00

(52) U.S. Cl. ..... 169/52; 169/46; 169/48; 169/67; 239/77

(58) Field of Search ..... 239/77, 78; 169/52, 169/67, 46, 48

(56) References Cited

U.S. PATENT DOCUMENTS 1,458,070 A * 6/1923 Long et al. ..... 126/271.2 A
3,362,397 A * 1/1968 Murphy ..... 126/271.2 A
3,698,380 A * 10/1972 Cook ..... 126/271.2 A
3,805,766 A * 4/1974 Hammon ..... 126/271.2 C
4,250,869 A * 2/1981 Doyle ..... 126/271.1
5,682,707 A * 11/1997 Chastain ..... 47/1.44

* cited by examiner

*Primary Examiner*—Robin O. Evans
(74) *Attorney, Agent, or Firm*—Law Office of Marc D. Mechtinger, Ltd.

(57) ABSTRACT

Land surface treating equipment in the form of firebreak-forming equipment includes a linearly extending combustion chamber defining shell formed to define a burning chamber in conjunction with land along which it is intended to be used once operatively positioned, fitted with a burner providing arrangement used for creating a combustion reaction within the chamber. The equipment further includes a fire extinguishing layout in the form of tubes extending along the sides of the shell, that are fitted with spaced nozzles aimed to discharge fire extinguishing agent alongside the shell during operative use. The equipment is towable along land via ski formations. The dispensing of combusted gases and other products take place via chimneys. The burner providing arrangement is fitted to the upstream side of the shell resulting in the ignition of growth on entering the chamber during progress of the equipment along land. The length of the shell extending rearward from the location of growth ignition promotes the burning to extinction of ignited growth within the burning zone. This effect is enhanced by the smothering effect within the chamber caused by the overwhelming presence of carbon monoxide and carbon dioxide during operative use of the equipment.

12 Claims, 4 Drawing Sheets

FIREBREAK-FORMING EQUIPMENT

This is a continuation of International Application No. PCT/ZA00/00126, filed Jul. 26, 2000, published as International Publication No. WO 01/07115, which is hereby incorporated by reference in its entirety.

BACKGROUND TO THE INVENTION

Uncontrolled fires occurring in nature pose a large problem as large tracts of land and forestry can be quickly destroyed by such fires. To counter this problem firebreaks are made along pre-selected routes. Fires that burn uncontrollably thus burn to extinction on reaching a firebreak. This aids in containing the devastation of large areas by fire. A firebreak can, in fact, also be used to commence making a counter fire thus enlargening the strip of land against which a fire burns to extinction.

1. Field of the Invention

This invention relates to land surface treating equipment for treating land in response to traversing it. Although not so limited the invention finds useful application for forming fire breaks.

2. Prior Art Description

The forming of firebreaks to control fires occurring in nature is on the one hand done by manually making a fire and controlling it to burn along the desired route. This procedure is very labour intensive and time consuming. Another method is clear a strip of growth by ploughing up or scraping a strip of land that is wide enough to serve as an effective firebreak. These methods create the possibility of erosion caused by the elements of nature.

BRIEF DESCRIPTION OF THE DRAWING

The invention is now described, by way of example, with reference to the accompanying drawings. In the drawings

DETAILED DESCRIPTION OF THE DRAWINGS

Figure 1:
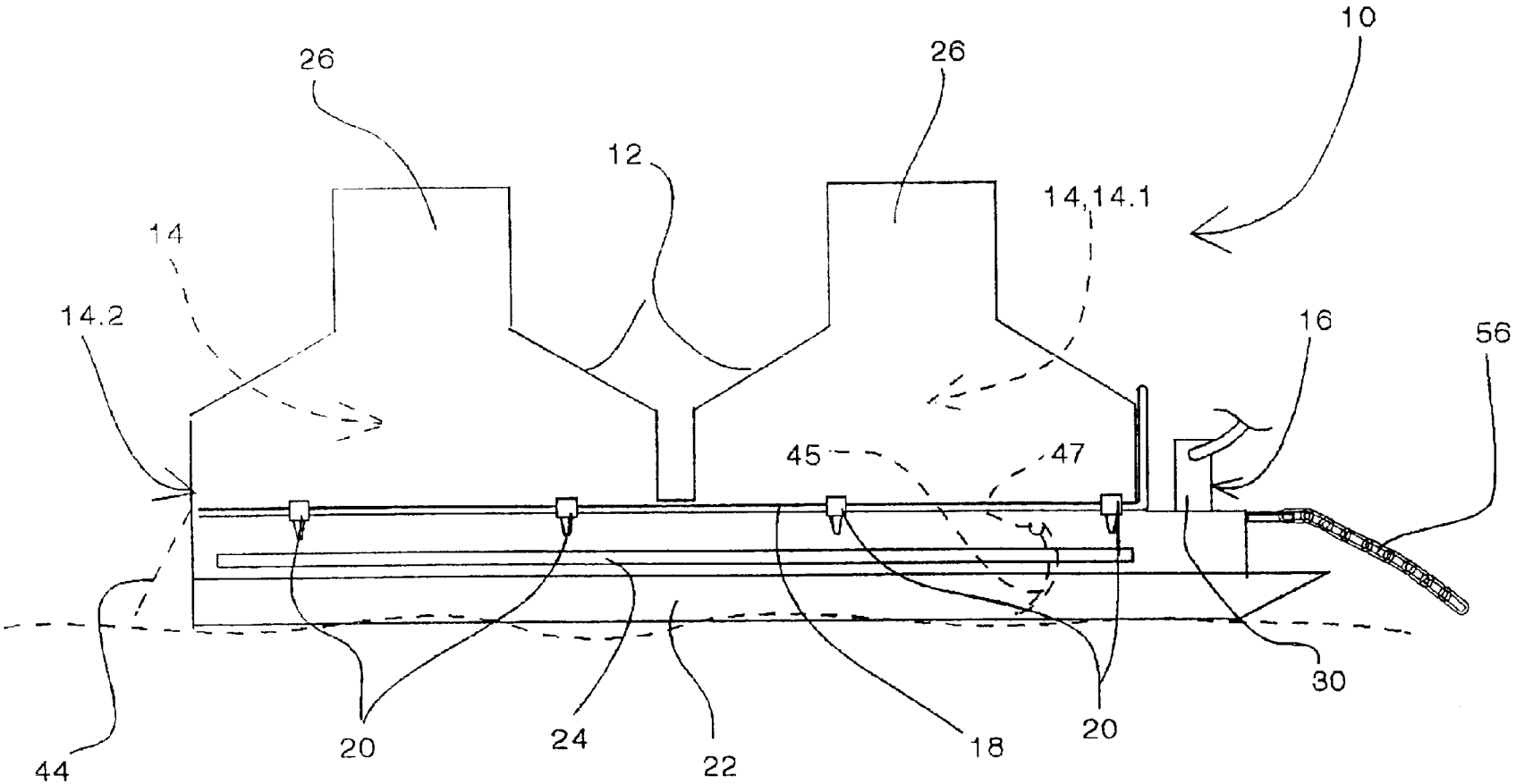
FIG. 1 shows land surface treating equipment in the form of firebreak-forming equipment in side elevation.

Referring to FIGS. 1 to 4 land surface treating equipment, according to the invention, in the form of firebreak-forming equipment is generally indicated by reference numeral 10.

The equipment 10 comprises a treatment chamber defining shell in the form of a linearly extending combustion chamber defining shell 12 formed to define a suitably ventilated burning chamber 14 in conjunction with land along which it is intended to be used once operatively positioned, fitted with a treatment medium discharge layout provided by a burner providing arrangement 16 used for creating a combustion reaction within the chamber 14.

The equipment 10 also includes a fire extinguishing layout provided by fire extinguishing liquid carrying tubing in the form of tubes 18 extending along the sides of the shell 12, that are fitted with spaced nozzles 20 aimed to discharge fire extinguishing agent alongside the shell 12 during operative use.

The equipment 10 is sledge-fashion towable along land with its lower edges being provided by skis 22.

The burner providing arrangement 16 is fitted to the upstream side of the shell 12 resulting in the ignition of growth on entering the chamber 14 during progress of the equipment 10 along land. The main burning effect, that is intense enough to rapidly and fully ignite burnable growth, thus takes place in the upstream part 14.1 of the burning chamber 14 with regard to the direction of travel of the equipment 10. As the shell 12 extends for an adequate distance rearward from the location of growth ignition the extent of ignited growth still burning towards the trailing end 14.2 of the chamber 14, once the equipment 10 is in use, is small as also promoted by the smothering effect caused by the overwhelming presence of carbon monoxide and carbon dioxide resulting from the burning effect of the burner providing layout 16.

Figure 5:
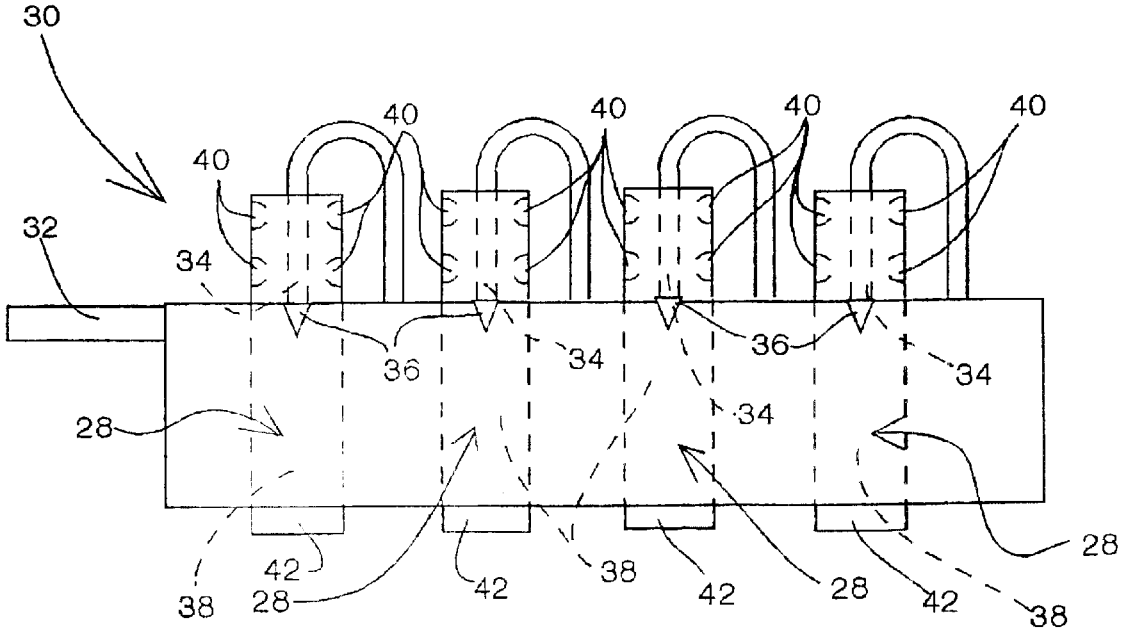
FIG. 5 shows the treatment medium discharge layout of the firebreak-forming equipment as provided by a burner layout.
Figure 6:
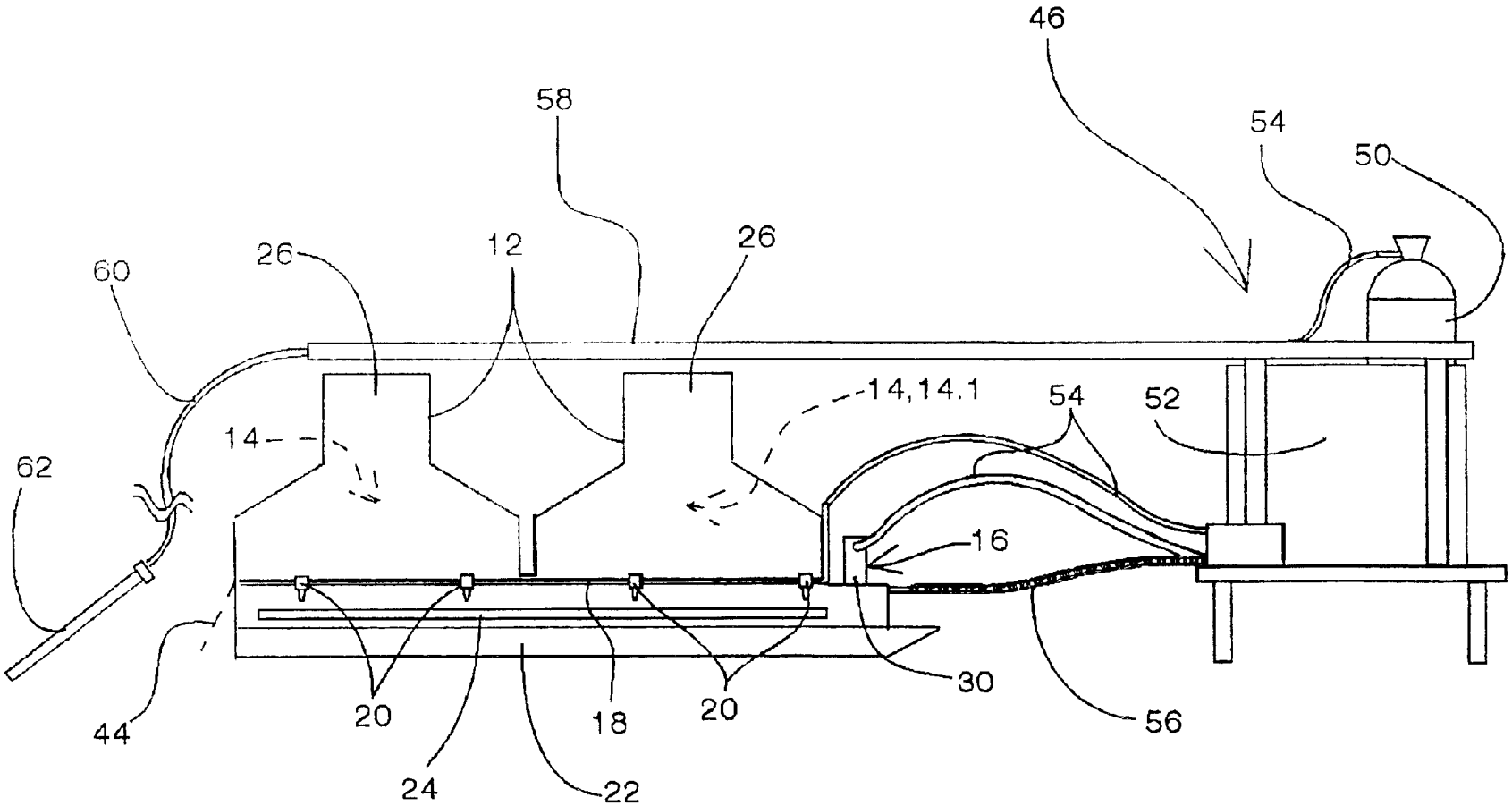
FIG. 6 shows the equipment as supplemented by a carrier for carrying the medium used in performing a firebreak-forming function.

To ensure a full burning front across the width of land entering the shell 12 the burner providing arrangement 16 is formed with a number of laterally spaced burning locations. It is clear that any conventional burning arrangement suitably for the circumstances can be used. Although not so limited the, use of gas fired burners are particularly useful as gaseous agent provides a rapid burning effect. In this regard and also referring to FIG. 5 a gas fired burner unit 30, forming the burner providing arrangement 16, presents a series of burner facilities 28 supplied from a common liquefied gas supply 32. The common supply 32 branches into a number of individual burner supply tubes 34 that each discharges the liquefied gas via a nozzle 36 into an combustion chamber 38 that is fitted with air intakes 40. On discharging from the nozzles 36 the gaseous agent thus evaporates and mixes with air with igniting taking place along the chambers 38 resulting in the provision of flames burning forth from a series of burners 42. The unit 30 is simply fitted to the shell 12 at the appropriate upstream position with the shell 12 being accommodatably formed.

It is clear that land along which the equipment 10 is intended for use will have to extend fairly evenly and without any large obstructions. It will, however, be appreciated that provision must be made that larger forms of growth and even some obstructions can pass along the burning chamber 14 without impeding the progress of the equipment 10 when operatively used. To address this problem the leading and tailing ends of the shell 12 are fitted with flap doors 44.

Figure 2:
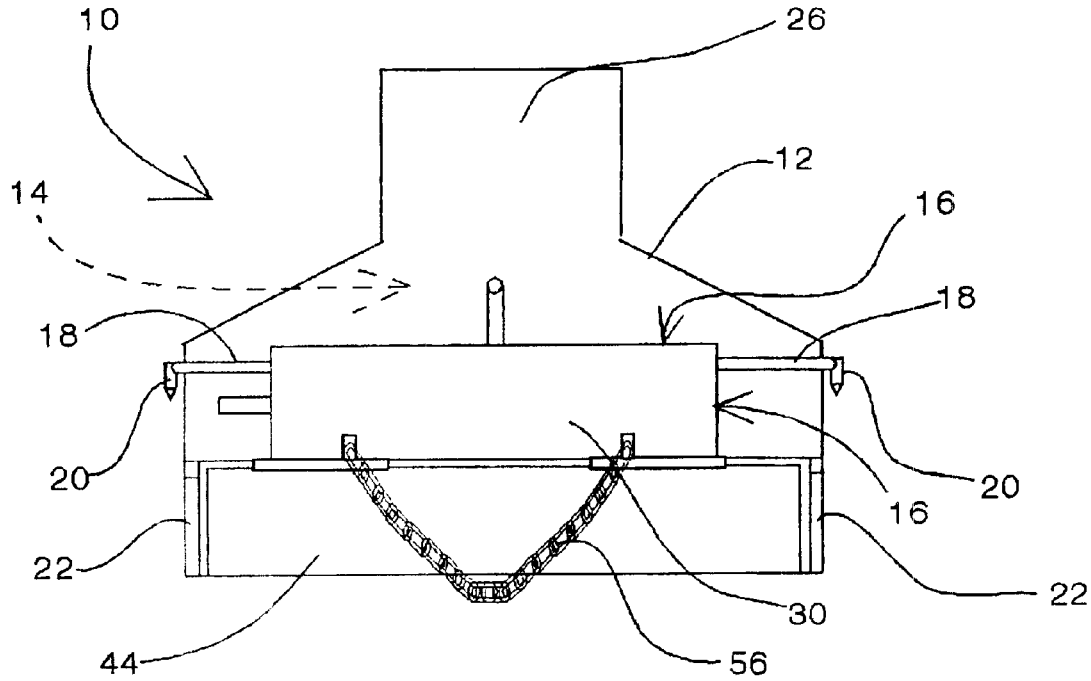
FIG. 2 shows the firebreak-forming equipment frontal view.
Figure 3:
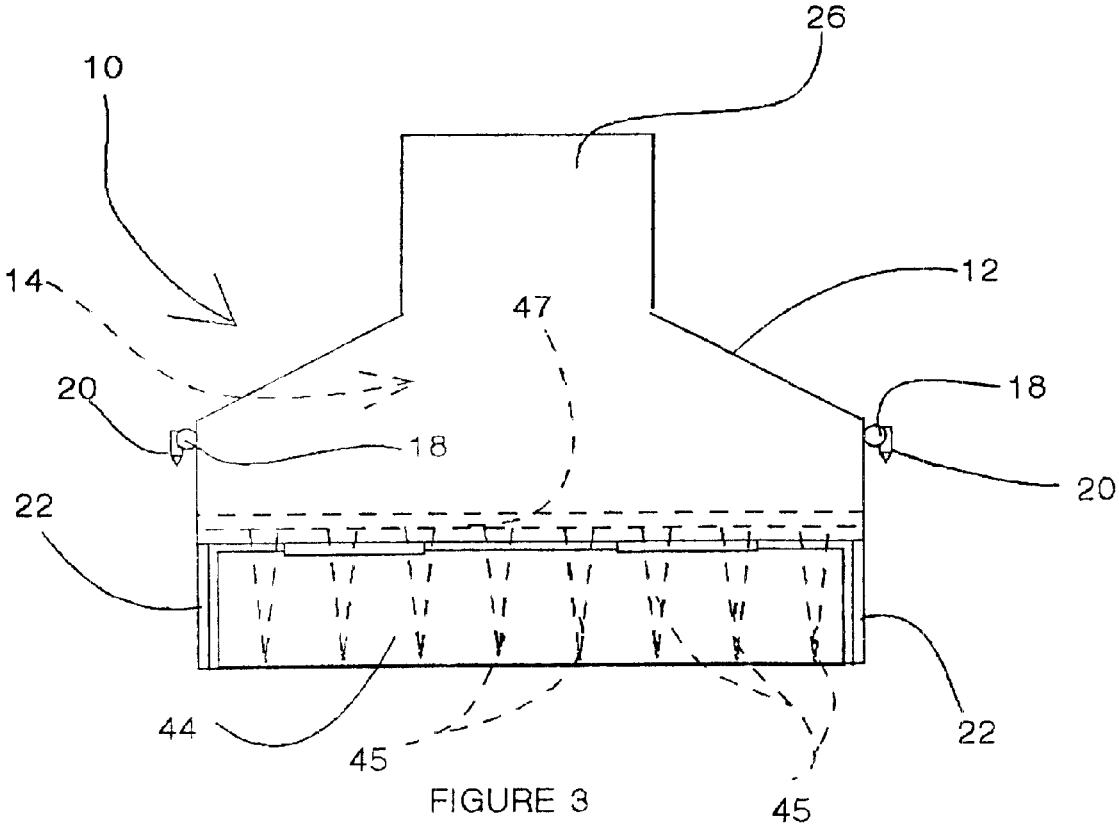
FIG. 3 shows the firebreak-forming equipment in end view.
Figure 4:
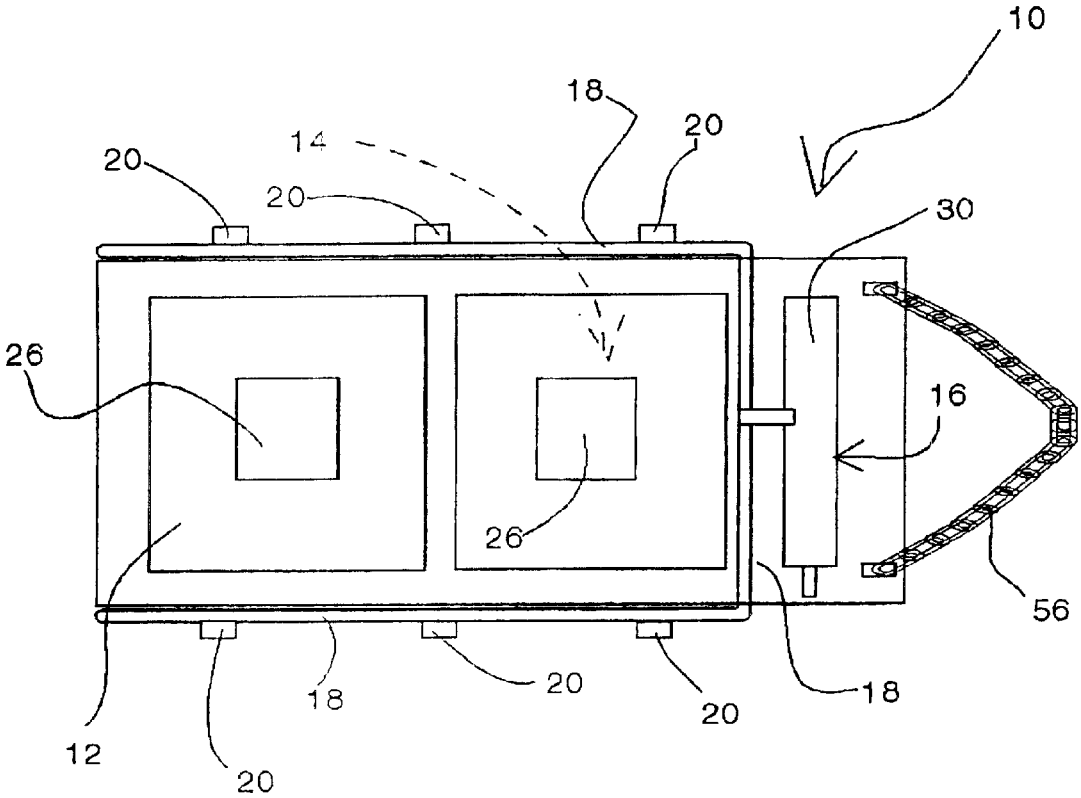
FIG. 4 shows the firebreak-forming equipment in plan view.

As shown in broken lines in FIGS. 1 and 2 the equipment 10 can also be fitted with a set of yieldable growth engaging tines 45 mounted transverse with respect to the direction of travel of the equipment 10 to the upstream part 14.1 of the chamber 14. The tines 45 will naturally be mounted to yield to obstructions such as rocks moving along the chamber 14 once the equipment 10 is in use. The tines 45 can typically extend from a shaft 47 biased to maintain the tines 45 in a land engaging condition though permitting their yielding when so required. The shaft 47 is mounted to extend between the inner walls of the shell 12. The tines 45 will have the beneficial effect of breaking up lumps of growth entering the chamber 14 that will promote their proper burning.

The equipment 10 makes provision for being towed by way of a towing cord such as a chain 56.

The carrier 46 is used for securely carrying a conventional gas cylinder 50 providing the burning agent and is also fitted with a water tank or reservoir 52, providing the extinguishing agent and is also fitted with a pump to deliver the water to the nozzles 20 once the carrier 46 is connected to the shell 12.

Provision for being connectable to the conventional three-point hitch of a towing vehicle so fitted, such as tractor (not shown), is provided on the carrier 46 by way of conventionally arranged coupling formations (not shown).

When ready for use the shell 12 is simply linked to the carrier 46 by means of the chain 56.

As this cannot always be fully achieved, particularly in the case of trailing fires, provision is made for manually applying fire-extinguish agent by way of one or more independently operable fire extinguishing agent supply hoses in the form of manually operable hoses 60 branching directly from the pump of the water supply reservoir 52.

Ignitable growth along the land is thus burnt in the burning chamber 14 while the sideways spreading of fire is contained by means of the fire extinguishing agent as discharging from the nozzles 20.

What is claimed is:

1. Land surface treating equipment for treating land by way of burning burnable growth conducive thereto and found on such land in response to the equipment, as serving a firebreak forming function, traversing it comprising:

a treatment chamber defining shell enclosing a treatment application zone in the form of a burning chamber in conjunction with land bordering it from below once the shell is operatively situated and which shell makes provision for suitable ventilation in ventilating the burning chamber enabling the atmospheric discharge of combusted product that does not settle on the land once the equipment is in operative use, a suitably supplied treatment medium discharge layout that provides a burner providing arrangement that is fitted to desirably discharge medium into the burning chamber to enable the effective burning of growth as found on land desired to be treated and as bordering the burning chamber once the equipment is operatively positioned for containing burning to a strip of land traversed by the equipment once in use, and a fire extinguishing layout that is fitted to the shell for the appropriate application of fire extinguishing agent in at least laterally, with respect to the direction of travel of the shell, containing the effect of burning treatment that is inclined to spread outside the burning chamber to the chamber, thereby limiting the possibility of the spreading of fire to burnable growth situated alongside the equipment on its operative traversal of land, the equipment, where not self driven, making provision for being towed behind a towing vehicle.

2. Land surface treating equipment as claimed in claim 1 in which the fire extinguishing layout is in the form of fire extinguishing liquid carrying tubing, as conventionally suppliable with a pressurised liquid fire extinguishing agent, that is suitably mounted to the outside of the shell and fitted with appropriately directed discharge nozzles to perform a fire extinguishing function once the equipment is in operative use.

3. Land surface treating equipment as claimed in claim 1 in which the burner providing arrangement is fitted to perform its burning effect at the upstream end of the combustion chamber as defined with respect to the direction of travel of the equipment.

4. Land surface treating equipment as claimed in claim 3 in which the shell extends adequately rearward from the position of performance of the burning effect to promote the extinctable combustion of growth within the combustion chamber resulting in the equipment making provision for limiting the emergence of fire from its trailing end, once operatively used.

5. Land surface treating equipment as claimed in claim 4 in which the shell is fitted with a number of serially arranged chimneys via which combusted product is atmospherically discharged.

6. Land surface treating equipment as claimed in claim 4 in which the upstream and downstream ends of the shell are closed off by flap doors to promote the unobstructed passage of the equipment over land by accommodating obstructions situated along the path of the equipment.

7. Land surface treating equipment as claimed in claim 2 that includes an agent supply carrier connectable to a towing vehicle and behind which the combustion chamber defining shell, requiring to be towed, is towably connected once the equipment is ready for use, that is used for carrying at least one of a burner combustion agent supply source and a fire extinguishing agent supply source of which the appropriate one, if not both where applicable, are supply fashion connected to the burner layout and the fire extinguishing layout respectively once the equipment is ready for use.

8. Land surface treating equipment as claimed in claim 7 in which the carrier, as at least carrying the fire extinguishing agent supply source, is fitted with a tank for holding and supplying liquid fire extinguishing agent.

9. Land surface treating equipment as claimed in claim 8 that incorporates at least one independently operable fire extinguishing agent supply hose connectable to a fire extinguishing agent supply source, as carried by the agent supply carrier once the equipment is ready for use, with the hose being suitably supported to prevent its interference with the operation of the combustion chamber defining shell while being of adequate length to enable its manual use for extinguishing any fires originating from and found outside the shell during operative use of the equipment.

10. Land surface treating equipment as claimed in claim 7 in which the carrier makes provision for being connectable to the conventional three-point hitch of a towing vehicle thus being elevatably carrier by such towing vehicle once the equipment is ready for use.

11. Land surface treating equipment as claimed in claim 1 in which the treatment chamber defining shell is fitted with skis thus providing for the slidable traversing of land by the equipment.

12. Land surface treating equipment as claimed in claim 1 in which the shell is fitted with yieldable growth engaging tines mounted transverse to the direction of travel of the equipment at its upstream end for promoting the breaking up of lumps of growth entering the treatment chamber during use of the equipment thereby to promote the burning of growth in forming a fire break.

* * * * *